US006050244A

United States Patent [19]

Wilhelm

[11] Patent Number: 6,050,244

[45] Date of Patent: Apr. 18, 2000

[54] INJECTOR SYSTEM FOR FREE-PISTON ENGINES

[76] Inventor: Kurt Wilhelm, Iltisweg 7, 33689 Bielefeld, Germany

[21] Appl. No.: 09/178,469

[22] Filed: Oct. 23, 1998

[51] Int. Cl.[7] ..... F02M 37/04

[52] U.S. Cl. ..... 123/507; 123/465 C

[58] Field of Search ..... 123/46 R, 46 A, 123/46 B, 46 SC, 46 E, 46 H, 507

[56] References Cited

U.S. PATENT DOCUMENTS

| | | | |
|---|---|---|---|
| 1,666,630 | 4/1928 | Pescara | 123/465 C |
| 2,452,193 | 10/1948 | Huber | 123/46 R |
| 2,461,222 | 2/1949 | Meitzler | 123/46 R |
| 2,462,854 | 3/1949 | Gates | 123/507 |
| 2,481,927 | 9/1949 | Hooker | 123/46 R |
| 2,846,987 | 8/1958 | Nettel | 123/507 |
| 4,048,971 | 9/1977 | Prichett | 123/507 |
| 5,448,979 | 9/1995 | Clarke | 123/507 |
| 5,473,893 | 12/1995 | Atchten | 123/465 C |

*Primary Examiner*—Carl S. Miller

*Attorney, Agent, or Firm*—Henry M. Feiereisen

[57] ABSTRACT

An injector system adapted for use in a free-piston engine, includes an injection pump designed in the form of a free-piston pump and having a pump piston accommodated in a cylinder for reciprocating within the cylinder for making a compression stroke from a bottom dead center to a top dead center and for making an expansion stroke from the top dead center to the bottom dead center, an injector nozzle disposed in an engine piston or in a cylinder head which oscillates axially together with the engine piston, for injecting fuel received from the injection pump into a working chamber of the free-piston engine, a stroke limiting piston bearing on a working chamber distant end of the pump piston, and a restriction mechanism for limiting the travel of the limiting piston and the travel of the pump piston in the directions of the compression stroke and the expansion stroke. The free piston pump is so installed in the engine piston or in the cylinder head that oscillates axially with the engine, that during the compression stroke, the pump piston travels towards the working space of the engine so that the pump piston is driven by forces as a result of its own mass inertia and forces of the mass inertia of the limiting piston.

7 Claims, 2 Drawing Sheets

INJECTOR SYSTEM FOR FREE-PISTON ENGINES

CROSS-REFERENCES TO RELATED APPLICATIONS

This application is based on German Patent Application, Serial No. 197 19 800.7-13, filed May 11, 1997, the subject matter of which is incorporated herein by reference.

BACKGROUND OF THE INVENTION

The invention relates to an injector system for engines, and more particularly to an injector system for free-piston engines.

Conventional injector systems for free-piston engines are designed similar to those for crankshaft engines. Conventional injector systems can also operate according to the "common rail" principle. These systems require an electronic fuel injection control which is technically very complex. The systems consume a relatively large amount of energy to inject the fuel and do not take advantage of physical characteristics of the free-piston engine.

SUMMARY OF THE INVENTION

It is thus an object of the invention to provide an improved injector system obviating the afore-stated drawbacks.

In particular, it is an object of the present invention to provide an improved injector system of the aforedescribed type which is of a rather simple construction, and yet requires very little energy for its operation and takes advantage of the physical characteristics of the free-piston engine.

These objects, and others which will become apparent hereinafter, are attained in accordance with the present invention by providing an injection pump which is constructed as a free-piston pump and mounted in the piston of the engine or in the cylinder head that oscillates with the engine in the axial direction, and which is driven by mass inertia forces. This construction fully utilizes the physical characteristics of the free-piston engine. The piston pump is of simple design and produces—without requiring additional controls—the required pressure at the correct moment.

In connection with small and single-acting free-piston engines, it may be suitable to omit in particular the rear hydraulic device for limiting the stroke because the limiting piston touches down at a low speed.

Depending on the size and the design of the engine, the amount of injected fuel can be controlled by providing the pump piston with helices (slanted control edges) and rotating the pump piston about an axis in two directions.

If externally actuatable injection nozzles are selected or if electric ignition is required, then one or more piezoelectric components can be installed to supply the required voltage at the correct moment.

Advantageously, less fuel can be injected into the working chamber of the engine if the compression is very high, simply by accommodating in the working chamber of the pump a spring-biased safety valve adapted to open in dependence of pressure.

If the degree of rotation of the pump piston and therefore the injected fuel quantity is determined by the differential pressure, the differential pressure can be advantageously influenced by a simple spring-biased plunger valve, without requiring expensive sensor technology and control devices, because the valve is controlled by the inertia forces of the weight mass of the valve piston and consequently opens in a pressure-independent manner.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
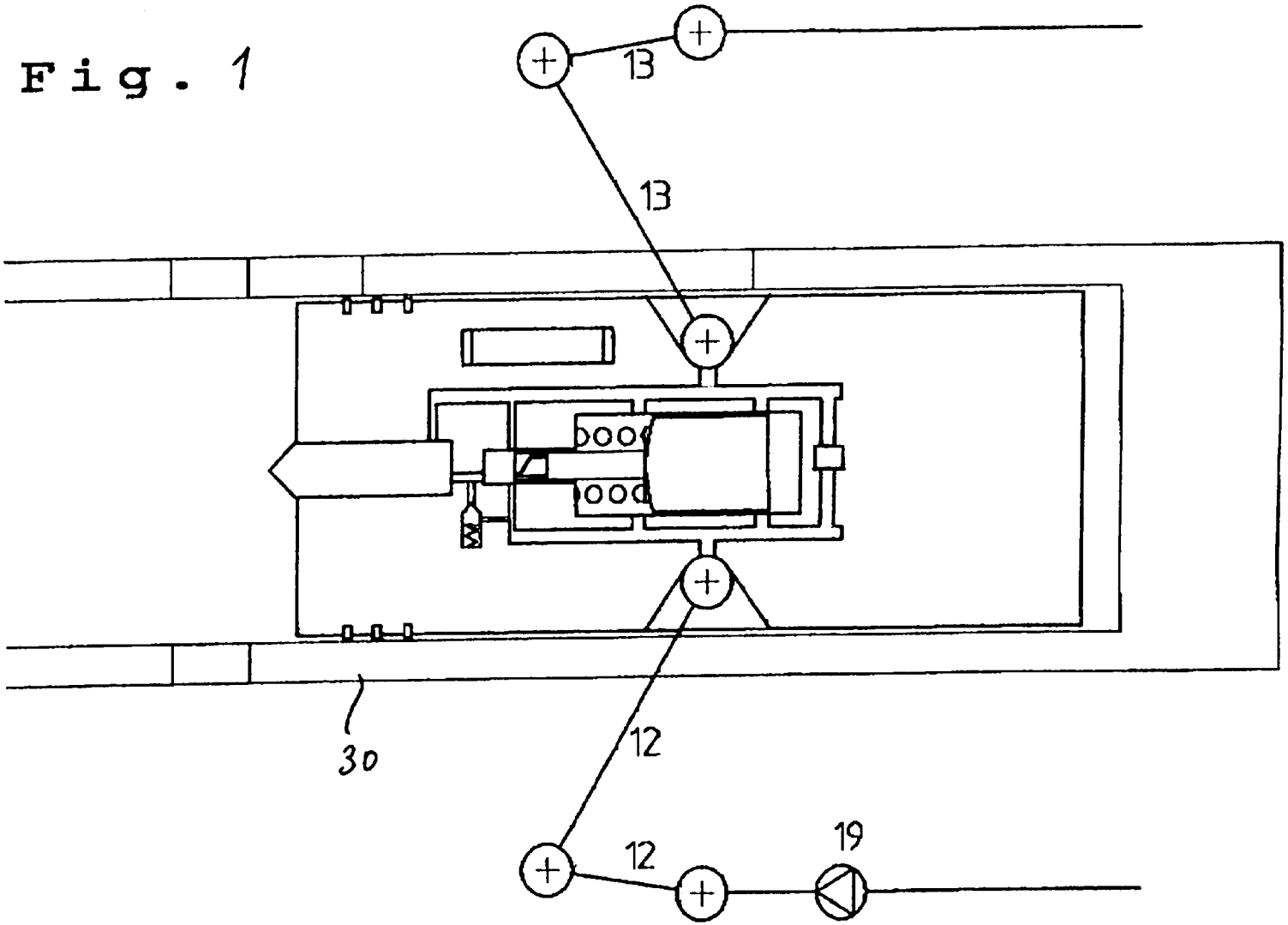
FIG. 1 is a partial longitudinal section of an embodiment of an injector system according to the present invention.

Throughout all the Figures, same or corresponding elements are generally indicated by same reference numerals.

Figure 2:
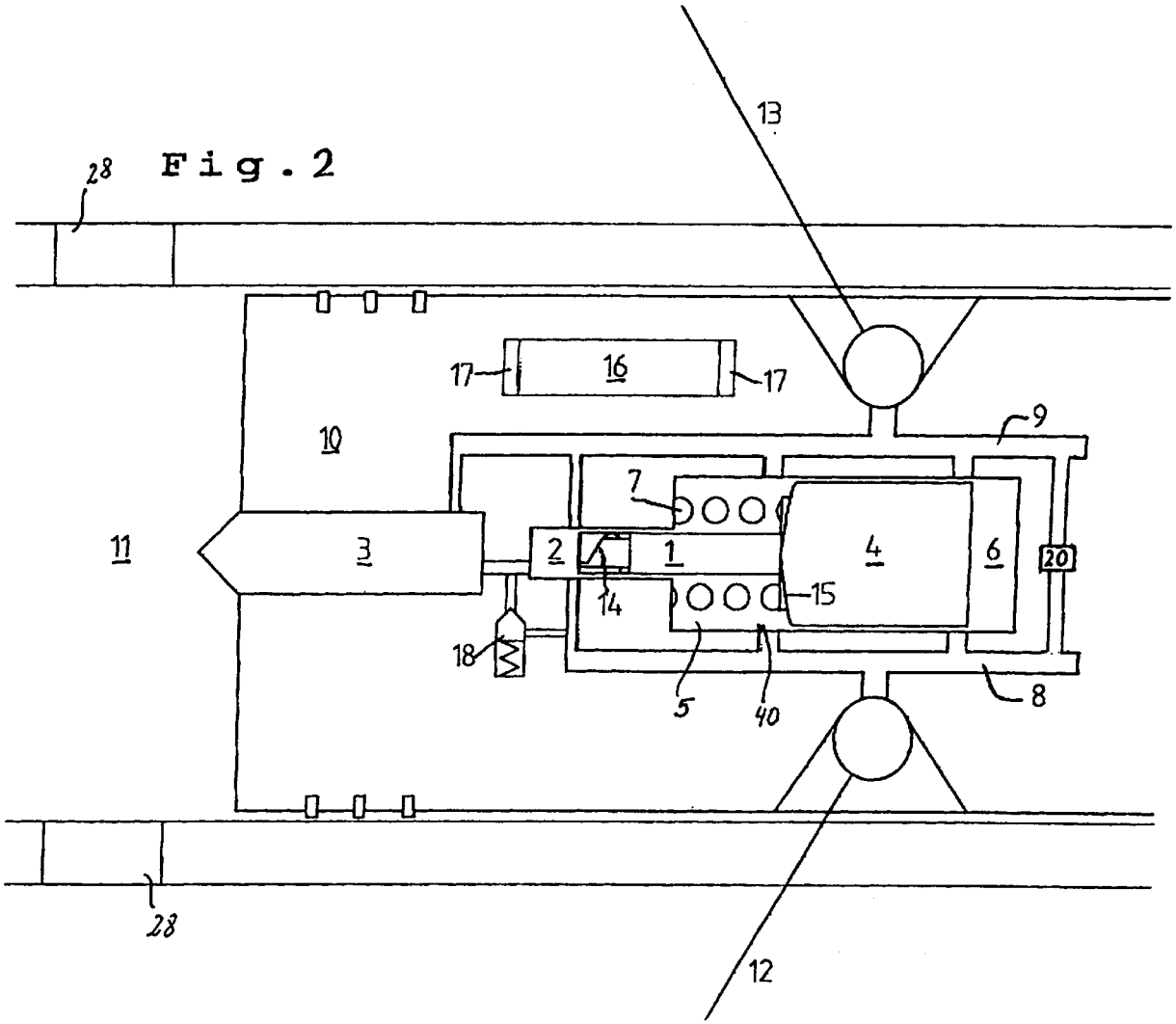
FIG. 2 is a schematic illustration, on an enlarged scale of the injector system of FIG. 1.

Turning now to FIGS. 1 and 2, there are shown one embodiment of an injector system according to the present invention, including a low pressure pump 19 which supplies fuel to an engine piston 10 via an articulated connecting rod 12 formed with suitable bores. The engine piston 10 reciprocates within a cylinder 30 and includes an injection nozzle 3 for injection of fuel into a working chamber 11 of the engine. The engine piston 10 is formed interiorly with a substantially cylinder-shaped compartment 40 which terminates in a forward prolongation of smaller diameter and accommodates an elongate pump piston 1 that bounds a working chamber 2. Received in the compartment 40 is a limiting piston 4 which subdivides the compartment 40 in a forward chamber or fuel cushion 5 and a rearward forward chamber or fuel cushion 6 for limiting the stroke of the limiting piston 4.

A bore 8 is formed in the engine piston 10 for supply of fuel from the pressure pump 19 into the working chamber 2 and compartment 40 of the injection pump 1, while fuel returns to the intake side of the low pressure pump 19 via a further bore 9 and an articulated connecting rod 13.

Acting on the working chamber distant end of the pump piston 1 is the limiting piston 4 which is securely fixed to the pump piston 1 and preferably formed with helices 15 in opposition to the pump piston 1.

The engine piston 10 reverses direction at the bottom dead center, whereby the limiting piston 4 bears upon the fuel cushion 6, before the engine piston 10 reaches the bottom dead center. The fuel cushion 6 is realized by fuel entering the compartment 40 from bore 8. The engine piston 10 then begins to accelerate and closes inlet and outlet slits 28 of the working chamber 11 of the engine. The gas pressure increases in the working chamber 11 of the engine Approximately at a compression ratio of 3:1, the vector of the axial forces acting on the engine piston 10 reverses direction so that as a result of an increasing pressure in the working chamber 11, the engine piston 10 increasingly decelerates.

This deceleration of the engine piston 10 is opposed by the limiting piston 4 in conjunction with the pump piston 1 and thus exerts a force on a spring 7 which extends in the forward compartment 5 between the limiting piston 4 and an opposite end face of the compartment 5 in which the limiting piston 4 moves. The mass inertia forces thus continue to increase until exceeding the spring force so that the pump piston I starts the delivery or compression stroke and closes the openings between the working chamber 2 and the bores 8, 9. As a result, pressure in the working chamber 2 of the pump builds up very rapidly so that the injector needle of the injector nozzle 3 is lifted, and fuel is injected into the working chamber 11 of the engine at high-pressure.

As indicated in particular in FIG. 2, the piston pump 1 is formed with one or more helices 14 so that the passage to bore 9 is cleared, thereby decreasing the pressure in the working chamber 2 of the pump. Consequently, the injector needle of the injector nozzle 3 closes again and the limiting piston bears upon the fuel cushion 5.

The engine piston 10 has reversed direction. When the compression reaches approximately 3:1, the mass forces have become low enough so that the spring 7 begins to push the pump piston 1 back. The mass inertia forces add to the force shortly thereafter. The pump piston 1 clears the openings between the working chamber 2 and the bores 8, 9 again to thereby allow fuel to fill and flush the working chamber 2 of the pump 1. The stroke limiting piston 4 impacts on the fuel cushion 6 at a relatively slow speed. The engine piston 10 thus has reached the lower dead point and reverses direction to start a new cycle.

If the compression of a free-piston engine is too high, the pressure in the working chamber 11 of the engine exceeds the maximum allowable pressure. The occurrence of excessive pressure is recognized by a safety valve 20 which is positioned between the bores 8, 9 and has a valve piston (not shown) which in response to a inadmissible pressure briefly opens the safety valve 20 so that fuel flows from the bore 8 to the bore 9, thereby reducing the differential pressure between the bores 8, 9.

It is also suitable to provide in the working chamber 2 of the pump a safety valve 18 which is formed as a plunger valve with a valve piston that is lifted off a complementary valve seat (not shown) before the maximum injection pressure is reached so that initially only the dead space of the working chamber 2 of the pump is increased and a bore is cleared by the valve piston only after the maximum injection pressure is exceeded.

As further shown in particular in FIG. 2, at least one axially freely movable weight mass 16 is positioned in the engine piston 1 or the cylinder that oscillates with the engine in the axial direction, for acting on piezoelectric devices 17 on one side or two sides. When the engine piston 10 is decelerated, the weight mass 16 applies a pressure on the piezoelectric devices 17, thereby generating a high voltage which can be used for an ignition.

Persons skilled in the art will understand that in large free-piston engines, multiple injection systems can be installed for each working chamber of the engine.

While the invention has been illustrated and described as embodied in a injector system for free-piston engines, it is not intended to be limited to the details shown since various modifications and structural changes may be made without departing in any way from the spirit of the present invention.

What is claimed as new and desired to be protected by Letters Patent is set forth in the appended claims:

What is claimed is:

1. An injector system adapted for use in a free-piston engine, comprising:

an injection pump designed in the form of a free-piston pump and having a pump piston accommodated in a cylinder for reciprocating within the cylinder for making a compression stroke from a bottom dead center to a top dead center and for making an expansion stroke from the top dead center to the bottom dead center;

an injector nozzle disposed in an engine piston or in a cylinder head which oscillates axially together with the engine piston, for injecting fuel received from the injection pump into a working chamber of the free-piston engine;

a stroke limiting piston bearing on a working chamber distant end of the pump piston; and restriction means for limiting the travel of the limiting piston and the travel of the pump piston in the directions of the compression stroke and the expansion stroke, wherein the free-piston pump is so installed in the engine piston or in the cylinder head that oscillates axially with the engine, that during the compression stroke, the pump piston travels towards the working space of the engine so that the pump piston is driven by forces as a result of its own mass inertia and forces of the mass inertia of the limiting piston.

2. The injector system of claim 1 wherein the restriction means is a mechanism selected from the group consisting of hydraulic means, pneumatic means and mechanical means.

3. The injector system of claim 1 wherein the pump piston is formed with one or more helices, and further comprising a controllable mechanism selected from the group consisting of mechanical means, hydraulic means and electric means for rotating the pump piston about an axis in both directions to adjust the effective stroke of the pump piston.

4. The injector system of claim 2 wherein the limiting piston of the hydraulic means is formed with helices for adjusting the stroke through turning of the limiting piston.

5. The injector system of claim 1, and further comprising at least one axially freely movable weight mass positioned in the engine piston 1 or the cylinder that oscillates with the engine in the axial direction, for acting on piezoelectric devices in one or in both directions.

6. The injector system of claim 1, and further comprising a safety valve accommodated in a working chamber of the pump and formed as a plunger valve with a valve piston which is lifted off a valve seat before the maximum injection pressure is reached so that initially only the dead space of the working chamber of the pump is increased and a bore is cleared by the valve piston only after the maximum injection pressure is exceeded.

7. The injector system of claim 1 wherein the injection pump has a first bore forming a fluid passage for supply of fuel into a working chamber of the pump and a second bore forming a fluid passage for discharge of fuel, and further comprising at least one spring-loaded safety valve positioned between the first and second bores and formed as plunger valves which have a valve piston installed axially or parallel to an axis so as to open the valve independent of pressure by its mass inertia forces when a maximal allowable compression or combustion pressure in the working space of the engine is exceeded.

* * * * *